US010603935B1

(12) United States Patent
Yasui et al.

(10) Patent No.: US 10,603,935 B1
(45) Date of Patent: Mar. 31, 2020

(54) OPENING AND CLOSING MECHANISM AND IMAGE FORMING APPARATUS

(71) Applicant: FUJI XEROX CO., LTD., Tokyo (JP)

(72) Inventors: Kazuya Yasui, Kanagawa (JP); Yoichi Takeuchi, Kanagawa (JP); Akira Numazaki, Kanagawa (JP); Satoshi Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/508,274

(22) Filed: Jul. 10, 2019

(30) Foreign Application Priority Data

Mar. 20, 2019 (JP) ..... 2019-052161

(51) Int. Cl.

| | |
|---|---|
| ***G03G 21/00*** | (2006.01) |
| ***B41J 23/02*** | (2006.01) |
| ***G03G 21/16*** | (2006.01) |
| ***B41J 29/13*** | (2006.01) |

(52) U.S. Cl.
CPC ..... *B41J 23/02* (2013.01); *B41J 29/13* (2013.01); *G03G 21/1633* (2013.01); *G03G 21/1661* (2013.01); *G03G 21/1647* (2013.01); *G03G 2221/169* (2013.01)

(58) Field of Classification Search
CPC ..... B41J 23/02; B41J 29/13; G03G 21/1633; G03G 21/1661; G03G 21/1647; G03G 21/1619; G03G 21/1604; G03G 21/1623; G03G 2221/169
See application file for complete search history.

(56) References Cited

U.S. PATENT DOCUMENTS 8,401,426 B2 * 3/2013 Nieda ..... E05C 19/02 399/114
10,241,465 B2 * 3/2019 Naganuma ..... G03G 21/1638

FOREIGN PATENT DOCUMENTS

JP 2011053281 3/2011
JP 2018056164 4/2018

* cited by examiner

*Primary Examiner* — Hoang X Ngo
(74) *Attorney, Agent, or Firm* — JCIPRNET

(57) ABSTRACT

An opening and closing mechanism includes an opening and closing door that is rotatably supported to be movable between a closed position where an opening of an apparatus body is covered and an opened position where the opening is opened, a link member provided in the apparatus body and rotatably supported by a rotary shaft, a guide member having a first guide surface that moves while being in contact with the link member in a case where the opening and closing door moves to the closed position and a second guide surface that moves while being in contact with the link member in a case where the opening and closing door moves to the opened position, and a switching member that guides the link member from the first guide surface to the second guide surface, in which the switching member includes a root portion and an arm extending from the root portion to an opposite side to the apparatus body, and a first rotational moment toward the first guide surface using the root portion as an axis is applied to the arm.

20 Claims, 13 Drawing Sheets

OPENING AND CLOSING MECHANISM AND IMAGE FORMING APPARATUS

CROSS-REFERENCE TO RELATED APPLICATIONS

This application is based on and claims priority under 35 USC 119 from Japanese Patent Application No. 2019-052161 filed Mar. 20, 2019.

BACKGROUND

(i) Technical Field

The present disclosure relates to an opening and closing mechanism and an image forming apparatus.

(ii) Related Art

An opening and closing mechanism including an apparatus body, an opening and closing member that is provided in the apparatus body to be openable and closeable, a fixing lever that is rotatably supported by any one of the apparatus body and the opening and closing member through a support shaft and fixes the opening and closing member in a closed state, a holding unit that movably holds the support shaft, a connected portion that is provided in the apparatus body or the opening and closing member on an opposite side to a side where the fixing lever is supported and that is connected to the fixing lever when the opening and closing member is closed, an elastic member that positions a rotation angle position of the fixing lever at one of two positions of a fixed position where the elastic member is connected to the connected portion to fix the opening and closing member and a standby position where the elastic member is connectable to the connected portion, a connection unit that acts on the fixing lever to move the fixing lever together with the support shaft to a connectable position to the connected portion when the opening and closing member is closed in a state in which the opening and closing member is separated from the apparatus body or the fixing lever is located in the fixed position, and a support shaft urging unit that urges the support shaft to a position corresponding to the standby position of the fixing lever has been known (see JP2011-053281A).

SUMMARY

Aspects of non-limiting embodiments of the present disclosure relate to an opening and closing mechanism and an image forming apparatus which aim to reduce an operation force in a case where an opening and closing door is opened or closed and to suppress damage of components.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an opening and closing mechanism including an opening and closing door that is rotatably supported to be movable between a closed position where an opening of an apparatus body is covered and an opened position where the opening is opened, a link member provided in the apparatus body and rotatably supported by a rotary shaft, a guide member having a first guide surface that moves while being in contact with the link member in a case where the opening and closing door moves to the closed position and a second guide surface that moves while being in contact with the link member in a case where the opening and closing door moves to the opened position, and a switching member that guides the link member from the first guide surface to the second guide surface, in which the switching member includes a root portion and an arm extending from the root portion to an opposite side to the apparatus body, and a first rotational moment toward the first guide surface using the root portion as an axis is applied to the arm.

BRIEF DESCRIPTION OF THE DRAWINGS

Exemplary embodiment(s) of the present invention will be described in detail based on the following figures, wherein.

DETAILED DESCRIPTION

Figure 1:
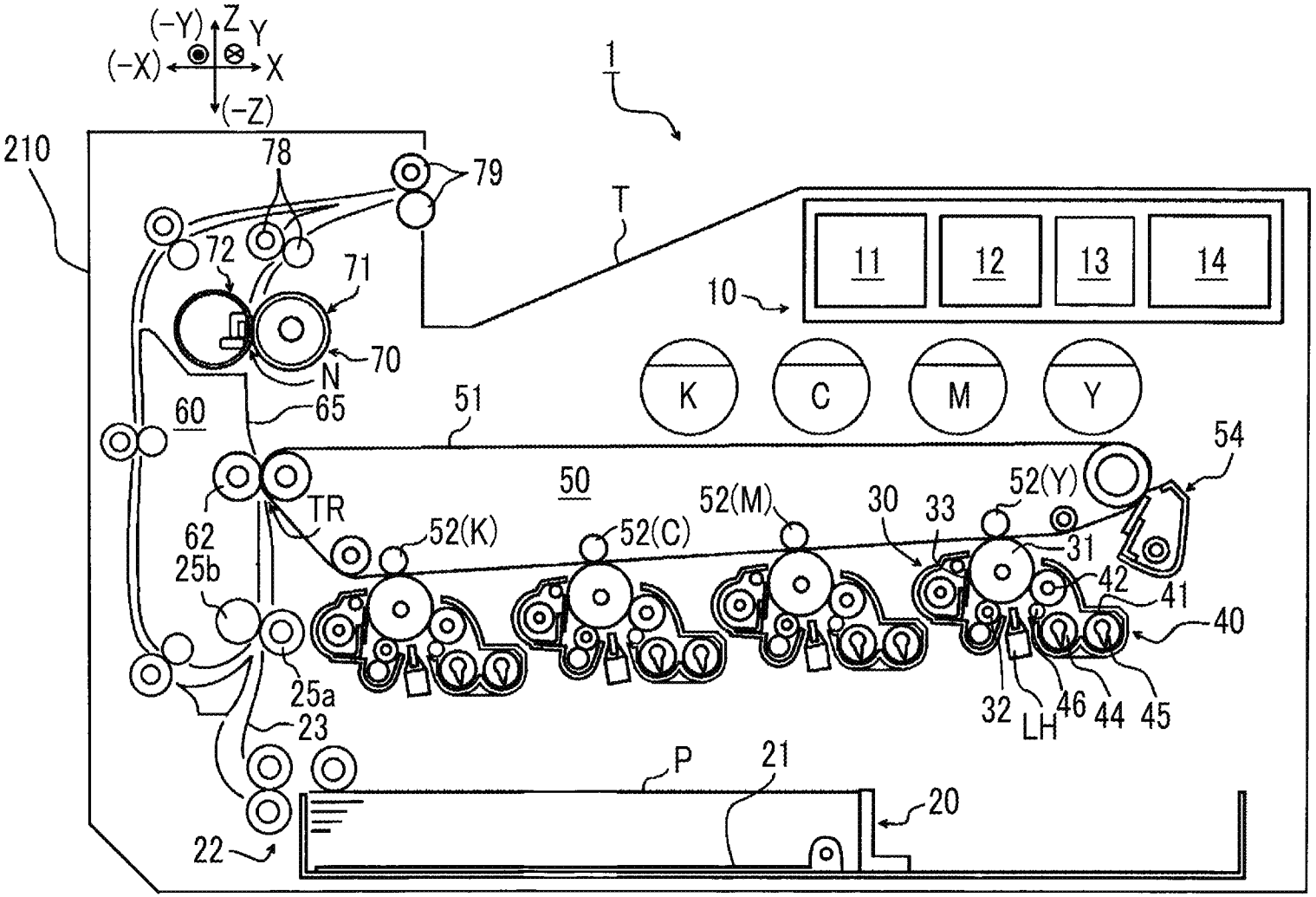
FIG. 1 is a schematic vertical sectional view showing an internal configuration of an image forming apparatus.

Next, the present disclosure will be described in more detail with reference to the accompanying drawings together with the following embodiments and specific examples. However, the present disclosure is not limited to these embodiments and specific examples. Further, in description using the following drawings, it should be noted that the drawings are schematic and a ratio or the like of each dimension is different from the actual one. For convenience of understanding, illustration of components other than members necessary for the description will be appropriately omitted. Further, for the convenience of the understanding of the following description, in the drawings, a front-rear direction is defined as an X axis direction, a left-right direction is defined as an Y axis direction, and an up-down direction is defined as a Z axis direction.

(1) Entire Configuration and Operation of Image Forming Apparatus

FIG. 1 is a schematic vertical sectional view showing an internal configuration of an image forming apparatus 1 according to the present exemplary embodiment. Hereinafter, the entire configuration and operation of the image forming apparatus 1 will be described with reference to the drawings.

The image forming apparatus 1 includes a control device 10, a sheet feeding device 20, photosensitive units 30, development units 40, a transfer unit 50, a paper sheet transporting unit 60, a fixing unit 70, and the like in a housing 100. A discharge tray portion T that discharges and accommodates a paper sheet on which an image is recorded is formed on an upper surface (the Z direction) of the image forming apparatus 1. Further, in a case where a paper sheet P is removed or checked in a case where the paper sheet P is jammed, an opening and closing door 210 that opens an inside of the image forming apparatus 1 is rotatably supported on a side surface (a −X direction) of the image forming apparatus 1.

The control device 10 has an image forming apparatus controlling unit 11 that controls an operation of the image forming apparatus 1, a controller unit 12 that prepares image data according to a printing processing request, an exposure controlling unit 13 that controls lighting of an exposure head LH, a power supply device 14, and the like. The power supply device 14 applies a high voltage to a charging roller 32, a development roller 42, a primary transfer roller 52, a secondary transfer roller 62, and the like, which will be described below, and supplies electric power to the exposure head LH, the sheet feeding device 20, the fixing unit 70, and each provided sensor.

The controller unit 12 converts printing information input from an external information transmission device (for example, a personal computer or the like) into image information for forming a latent image, and outputs a driving signal to the exposure head LH at a predetermined timing. The exposure head LH of the present embodiment is configured by a light emitting diode (LED) head in which a plurality of light emitting elements (LEDs) are arranged in a linear shape along a main scanning direction.

The sheet feeding device 20 is provided in a bottom portion of the image forming apparatus 1. The sheet feeding device 20 includes a paper sheet stacking plate 21, and a plurality of paper sheets P as recording media are stacked on an upper surface of the paper sheet stacking plate 21. The paper sheets P stacked on the paper sheet stacking plate 21 are extracted from the upper side to the front side (the −X direction) by a paper sheet extracting unit 22 one by one, and are then transported to a nip portion of a resist roller pair 25 including a driving roller 25*a* and a driven roller 25*b* via a paper sheet guide 23.

The photosensitive units 30 are provided in parallel with each other above the sheet feeding device 20 (in the Z direction), and each include photosensitive drums 31. The charging roller 32, the exposure head LH, the development unit 40, the primary transfer roller 52, and a cleaning blade 33 are arranged around the photosensitive drum 31 along a rotational direction.

The development unit 40 has a development housing 41 in which a developer is accommodated. A development roller 42 disposed to face the photosensitive drum 31 is disposed in the development housing 41 and a pair of augers 44 and 45 that stir and transport the developer to the development roller 42 side are disposed obliquely below the rear surface side of the development roller 42. A layer regulating member 46 that regulates the layer thickness of the developer is disposed close to the development roller 42. The development units 40 are configured in substantially the same manner except for the developers accommodated in the development housings 41, and form toner images of yellow Y, magenta M, cyan C, and black K, respectively.

The surface of the rotating photosensitive drum 31 is charged by the charging roller 32, and an electromagnetic latent image is formed by a latent image forming light beam emitted from the exposure head LH. The electrostatic latent image formed on the photosensitive drum 31 is developed as a toner image by the development roller 42.

The transfer unit 50 includes an intermediate transfer belt 51 on which toner images having respective colors, formed on the photosensitive drums 31 of the photosensitive units 30, are transferred in multiple manners, and primary transfer rollers 52 that sequentially transfer (primarily transfer) the toner images having the respective colors, formed on the photosensitive units 30, to the intermediate transfer belt 51. Further, the transfer unit 50 includes an intermediate transfer belt cleaner 54 that removes residual toner attached onto the intermediate transfer belt 51.

The paper sheet transporting unit 60 includes the driven roller 25*b* of the resist roller pair 25, which corrects a posture of the paper sheet P fed from the sheet feeding device 20 and sends the paper sheet P to a secondary transfer portion TR according to a secondary transfer timing, and the secondary transfer roller 62 which collectively transfers (secondarily transfers) the toner images having the respective colors overlapped and transferred on the intermediate transfer belt 51, to the paper sheet P serving as a recording medium. Further, the paper sheet P on which the transferred toner image is held is guided to a fixing nip portion N of the fixing unit 70 through a transport guide 65.

The toner images having the respective colors formed on the photosensitive drums 31 of the respective photosensitive units 30 are sequentially electrostatically transferred (primarily transferred) onto the intermediate transfer belt 51 by the primary transfer rollers 52 to which a predetermined transfer voltage is applied from the power supply device 14 or the like controlled by the image forming apparatus controlling unit 11, so that a superimposed toner image is formed in which the toners having the respective colors are superimposed.

The superimposed toner image on the intermediate transfer belt 51 is transported to the secondary transfer portion TR as the intermediate transfer belt 51 moves. In a case where the superimposed toner image is transported to the secondary transfer portion TR, the paper sheet P is supplied from the resist roller pair 25 to the secondary transfer portion TR in accordance with this timing. Then, a predetermined transfer voltage is applied from the power supply device 14 or the like controlled by the image forming apparatus controlling unit 11 to the secondary transfer roller 62, and the multiple toner images on the intermediate transfer belt 51 are collectively transferred to the paper sheet P sent from the resist roller pair 25.

The residual toner on the surfaces of the photosensitive drums 31 is removed by the cleaning blade 33 and is collected in a waste toner collection container (not shown). The surfaces of the photosensitive drums 31 are recharged by the charging roller 32.

The fixing unit 70 has a heating module 71 and a pressing module 72, and the fixing nip portion N (a fixing area) is formed by a pressure contact area between the heating module 71 and the pressing module 72. The paper sheet P on which the toner image is transferred in the secondary transfer portion TR is transported to the fixing unit 70 via the transport guide 65 in a state in which the toner image is not fixed. The toner image is fixed to the paper sheet P transported to the fixing unit 70, by an action of heating and pressure bonding by the pair of the heating module 71 and the pressing module 72.

The paper sheet P on which the fixed toner image is formed is discharged from a discharge roller pair 79 to a discharge tray portion T on the upper surface of the image forming apparatus 1 through a transport roller pair 78. Further, in the case of double-sided printing, at a time point at which a rear end of the paper sheet P of which the surface is fixed passes through the transport roller pair 78, the discharge roller pair 79 is reversely driven, and an image is formed on a rear surface transported from a reverse transport path formed inside the opening and closing door 210 to the resist roller pair 25.

(2) Configuration and Operation of Paper Sheet Transporting Section

Figure 2:
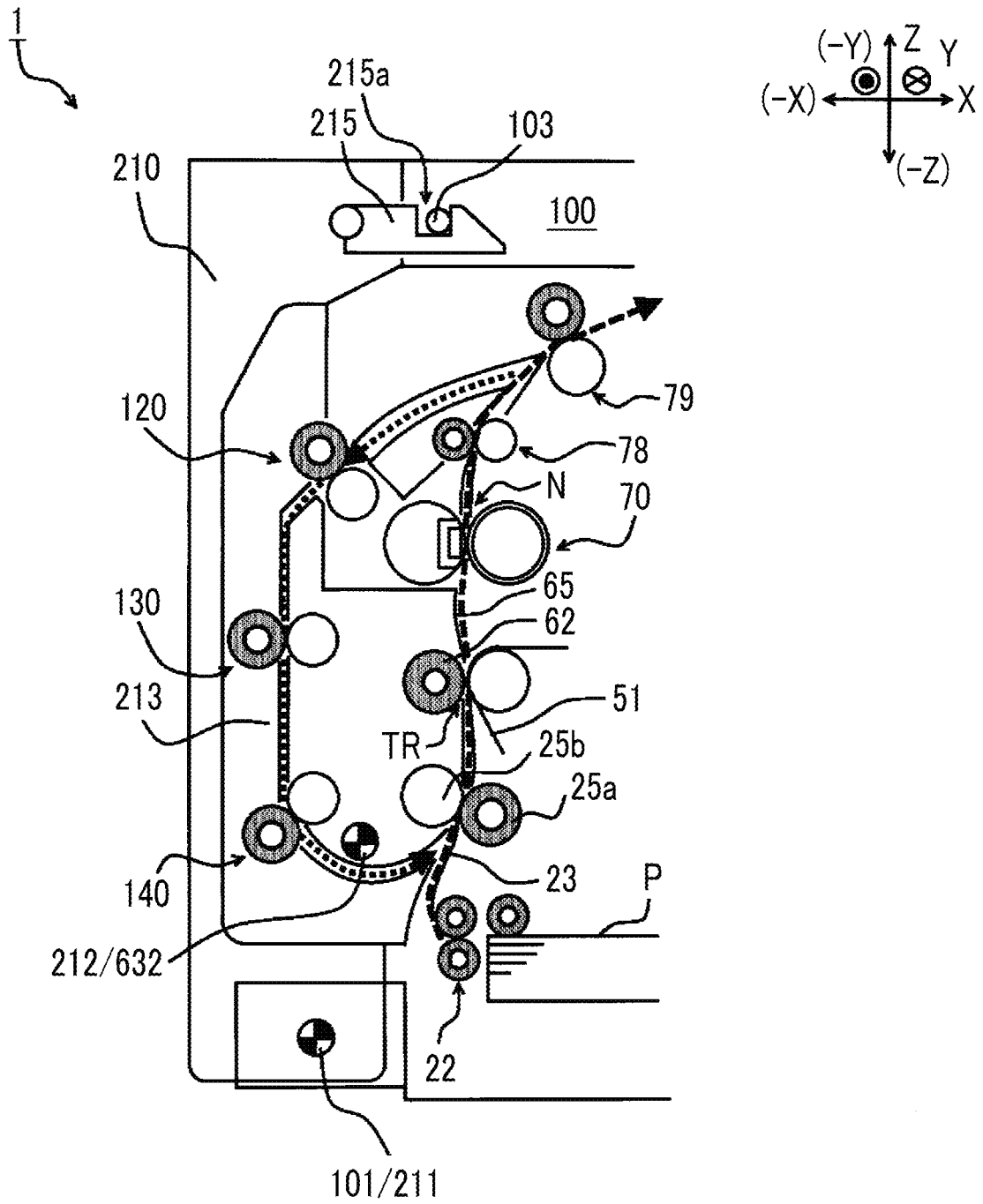
FIG. 2 is a schematic sectional view showing an internal configuration and paper sheet transport of a paper sheet transporting section.
Figure 3:
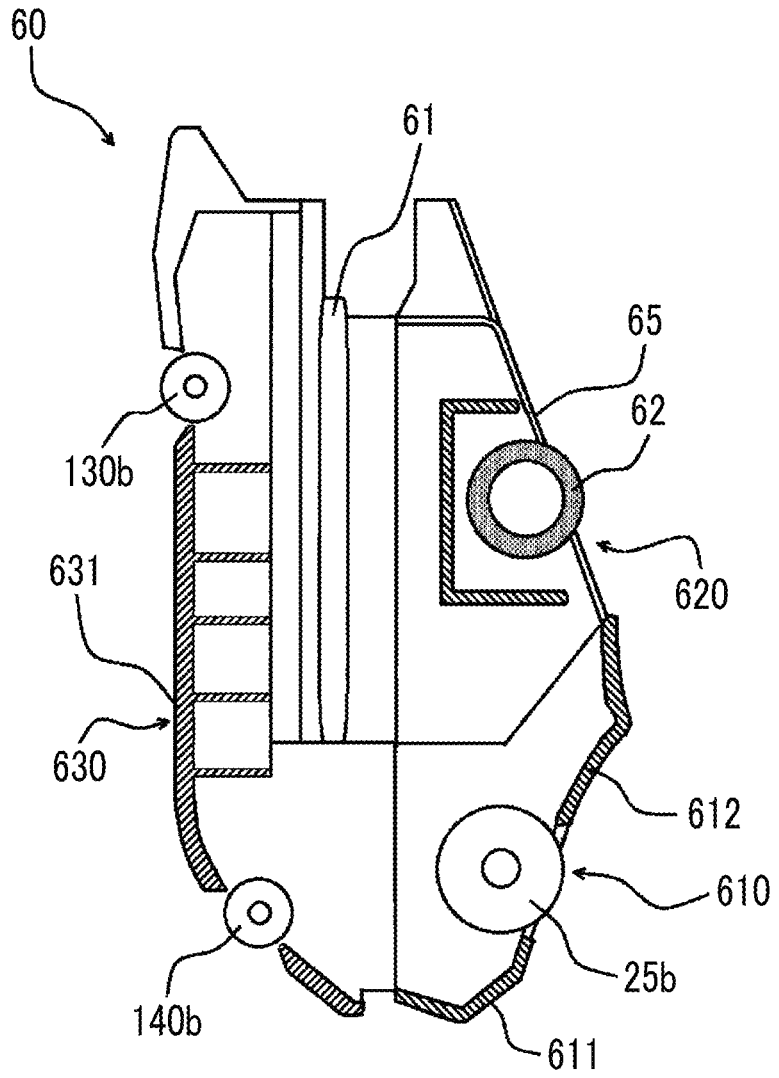
FIG. 3 is a schematic sectional view showing a paper sheet transporting unit.
Figure 4A:
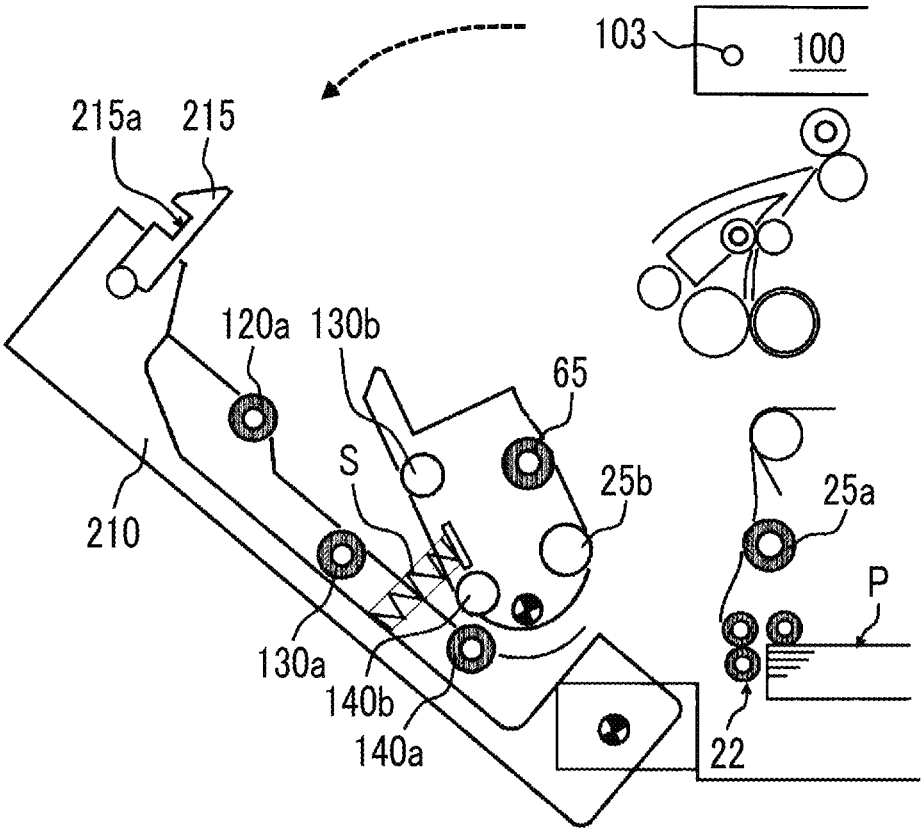
FIG. 4A is a schematic view showing a positional relationship between an opening and closing door and the paper sheet transporting unit when the paper sheet transporting section is opened.
Figure 4B:
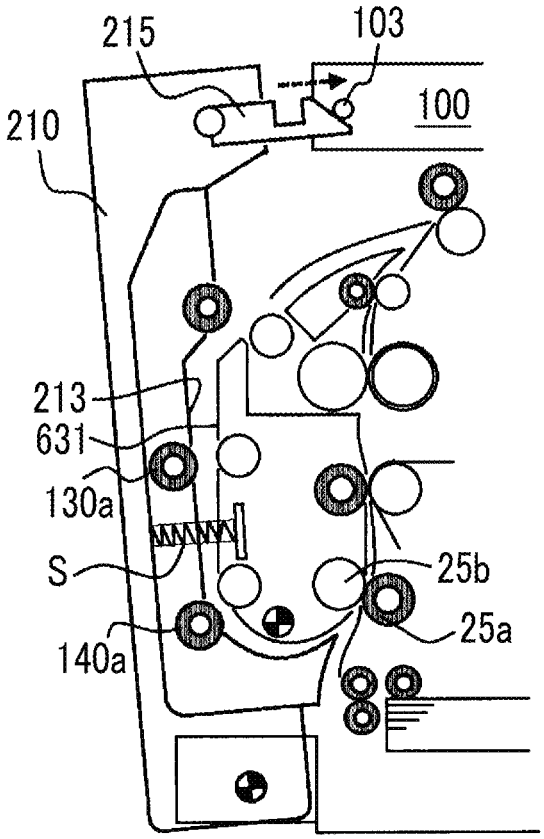
FIG. 4B is a schematic view of the paper sheet transporting section showing movement of the paper sheet transporting unit according to a closing operation of the opening and closing door.
Figure 5A:
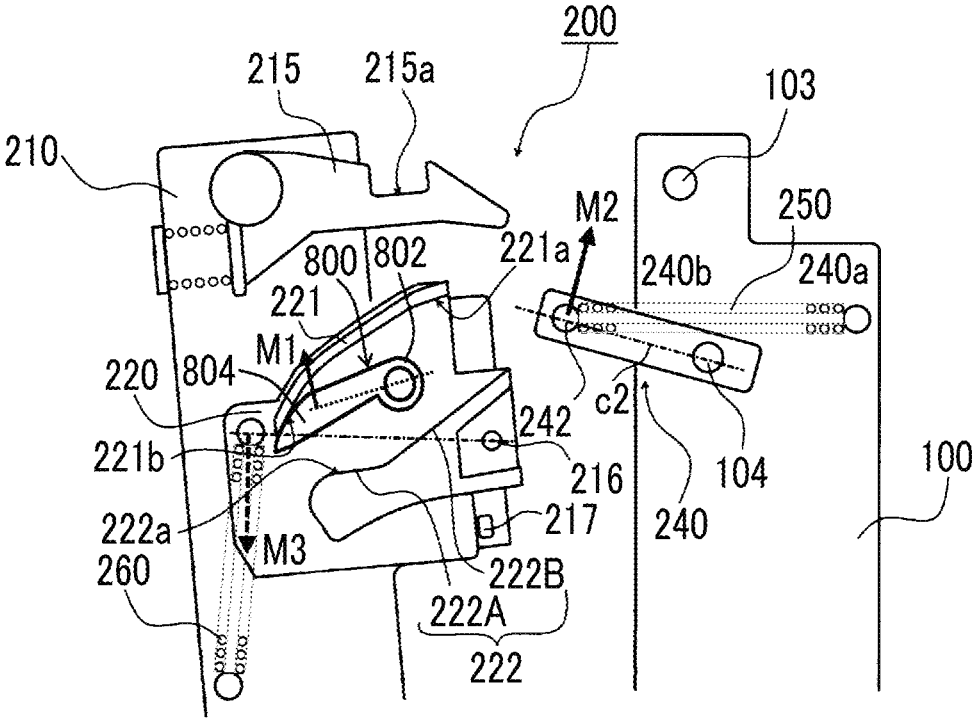
FIG. 5A is a schematic view showing a configuration of the opening and closing mechanism.
Figure 5B:
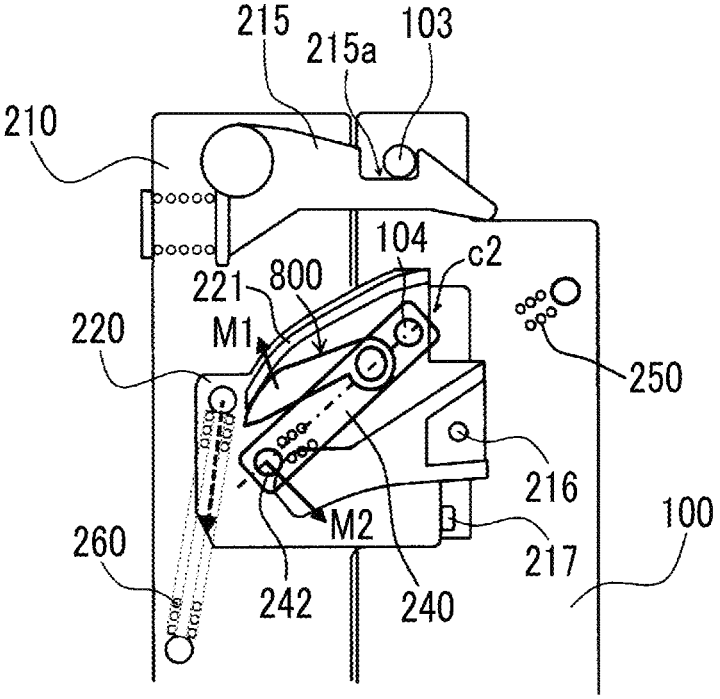
FIG. 5B is a schematic view showing the opening and closing mechanism in a state in which the opening and closing door is locked in a closed position.

FIG. 2 is a schematic sectional view showing an internal configuration and paper sheet transport of a paper sheet transporting section, FIG. 3 is a schematic sectional view showing a paper sheet transporting unit 60, FIG. 4A is a schematic view showing a positional relationship between an opening and closing door 210 and the paper sheet transporting unit 60 when the paper sheet transporting section is opened, FIG. 4B is a schematic view of the paper sheet transporting section showing movement of the paper sheet transporting unit 60 according to a closing operation of the opening and closing door 210, FIG. 5A is a schematic view showing a configuration of the opening and closing mechanism 200, and FIG. 5B is a schematic view showing the opening and closing mechanism 200 in a state in which the opening and closing door 210 is locked in a closed position.

Hereinafter, a configuration and an operation of the paper sheet transporting section of the image forming apparatus 1 will be described with reference to the accompanying drawings.

The paper sheet transporting unit includes the housing 100, the opening and closing mechanism 200 including the opening and closing door 210, and the paper sheet transporting unit 60.

(2.1) Housing

The housing 100 has an opening portion on a lateral side (the −X direction) thereof, and the photosensitive unit 30, the development unit 40, the transfer unit 50, and the like are accommodated inside the housing 100. A bearing portion 101 serving as a rotational center of the opening and closing door 210 is formed at a lower end of the opening portion side of the housing 100 and rotatably supports a rotary shaft 211 of the opening and closing door 210, which will be described below.

A lock pin 103 is provided at an upper portion of the opening portion side of the housing 100 to protrude in a direction intersecting an opening and closing direction of the opening and closing door 210. Then, the opening and closing door 210 in which a recess 215*a* of a latch lever 215 rotatably provided at an upper portion of the opening and closing door 210 is fitted into the lock pin 103 and is fixed to the housing 100 in a state in which the opening portion is closed.

(2.2) Opening and Closing Door

The opening and closing door 210 rotatably supports the paper sheet transporting unit 60 therein, supports the rotary shaft 211 of the bearing portion 101 of the housing 100, and rotates and moves between a closed position where the opening portion of the housing 100 is blocked and an opened position where the opening portion is opened. An outer transport guide 213, which is one of reverse transport paths through which the paper sheet P of which a transport direction is reversed after the surface of the paper sheet P is fixed passes until the paper sheet P is joined to the resist roller pair 25 again, is formed on an inner surface facing the housing 100 of the opening and closing door 210.

The outer transport guide 213 holds a predetermined gap with an inner transport guide 631 formed in the paper sheet transporting unit 60 to form a reverse transport path. A plurality of transport roller pairs 120, 130, and 140 are arranged inside the reverse transport path, and driving transport rollers 120*a*, 130*a*, and 140*a* constituting the transport roller pairs 120, 130, and 140 are arranged in the outer transport guide 213.

(2.3) Paper Sheet Transporting Unit

The paper sheet transporting unit 60 includes a resist unit 610, a secondary transfer unit 620, and a double-sided unit 630.

The resist unit 610 has a first paper sheet guide 611, the driven roller 25*b* of the resist roller pair 25, and a second paper sheet guide 612. The driving roller 25*a* of the resist roller pair 25 is disposed on an apparatus body side. The first paper sheet guide 611 guides the paper sheet P sent from the sheet feeding device 20 and the paper sheet P transported through the double-sided unit 630 to the nip portion of the resist roller pair 25. The second paper sheet guide 612 guides the paper sheet P sent from the resist roller pair 25 after a posture of the paper sheet P is corrected, to the secondary transfer unit TR.

The secondary transfer unit 620 has the secondary transfer roller 62 and the transport guide 65. The toner images held on the intermediate transfer belt 51 by the secondary transfer roller 62 urged to the intermediate transfer belt 51 side are collectively transferred (secondarily transferred) onto the paper sheet P sent at a secondary transfer timing. The paper sheet P onto which the toner images are transferred is guided to the fixing nip portion N of the fixing unit 70 through the transport guide 65.

The double-sided unit 630 has an inner transport guide 631 facing the outer transport guide 213 formed on an inner surface side of the opening and closing door 210 and constituting the other surface side of the reverse transport path, and transports the paper sheet P of which both surfaces are printed, to the resist roller pair 25. A pinch roller 130*b* of the transport roller pair 130 and a pinch roller 140*b* of the transport roller pair 140 are rotatably disposed in the inner transport guide 631.

Further, a pair of left and right rotary shaft portions 632 is formed on a lower side of the inner transport guide 631. The rotary shaft portions 632 are inserted into bearing portions 212 formed in both side plates 210*a* of the opening and closing door 210, and the paper sheet transporting unit 60 is rotatably supported by the opening and closing door 210.

As shown in FIGS. 4A and 4B, one end of a compression coil spring S is fixed to both sides of the inner transport guide 631, and the other end of the compression coil spring S is fixed to an inner surface side of the opening and closing door 210, which faces the inner transport guide 631. Accordingly, when the opening and closing door 210 is fixed at a closed position, an urging force of the compression coil spring S is applied between the paper sheet transporting unit 60 and the opening and closing door 210.

Therefore, in a case where the opening and closing door 210 moves to an opened position, the paper sheet transporting unit 60 rotates as the opening and closing door 210 moves. As a nipped state of the resist roller pair 25 is released, nipped states of the secondary transfer roller 62 and the intermediate transfer belt 51 in the secondary transfer portion TR are released. Then, the inner transport guide 631 and the outer transport guide 113 forming the reverse transport path are opened from each other by the urging force of the compression coil spring S, so that nipped states of the transport roller pairs 120, 130, and 140 are also released.

In a case where the opening and closing door 210 returns from the opened position to the closed position, the opening and closing door 210 is rotationally moved to the housing 100 side. According to the rotational movement of the opening and closing door 210 to the housing 100 side, the paper sheet transporting unit 60 is also rotationally moved to the housing 100 side. While receiving a reaction force due to the nipped state of the resist roller pair 25 and the nipped state of the secondary transfer roller 62 in the secondary transfer portion TR, the recess 215*a* of the latch lever 215 is fitted and fixed into the lock pin 103.

(2.4) Opening and Closing Mechanism

Next, the opening and closing mechanism will be described. FIG. 5A is a schematic view showing a configuration of the opening and closing mechanism, and FIG. 5B is a schematic view showing the opening and closing mechanism in a state in which the opening and closing door 210 is locked in a closed position. In each drawing after FIG. 5, in order to facilitate understanding of a configuration of the opening and closing mechanism, there is a portion where parts of tensile coil springs 250 and 260 are omitted. Further, a link member 240 penetrating an upper side of a switching member 800 (a front surface side of the switching member 800) is drawn in a penetrative manner.

The opening and closing mechanism 200 includes the opening and closing door 210, a guide member 220 disposed in the opening and closing door 210, the switching member 800 to which a first rotational moment M1 is applied by a first elastic member (described later), the link member 240 disposed in the housing 100, the tensile coil spring 250 as an example of a second elastic member that applies a second rotational moment M2 to the link member 240, and the tensile coil spring 260 as an example of a third elastic member that applies a third rotational moment M3 to the guide member 220.

The guide member 220 is rotatably supported on the support shaft 216 below the latch lever 215 above the opening and closing door 210. In a state in which the third rotational moment M3 is applied to one end of the guide member 220 as the tensile coil spring 260 is hung on the one end of the guide member 220, the guide member 220 comes into contact with a butting portion 217 provided in the opening and closing door 210, so that rotation of the guide member 220 is regulated.

Further, as shown in FIG. 5A, the guide member 220 has a first guide surface 221 that moves while coming into contact with a stud 242 of the link member 240, which will be described below, in a case where the opening and closing door 210 moves to the closed position and a second guide surface 222 that moves while coming into contact with the stud 242 of the link member 240 in a case where the opening and closing door 210 moves to the opened position.

The first guide surface 221 forms a movement trajectory extending obliquely downward from a starting end 221*a* receiving the stud 242 of the link member 240 to a terminal end 221*b* in a case where the opening and closing door 210 moves to the closed position.

The second guide surface 222 is formed below the first guide surface 221, includes a first guide portion 222A having a gentle inclination angle along a movement direction of the opening and closing door 210 and a second guide portion 222B having a steeper inclination angle than the inclination angle of the first guide portion 222A in a direction intersecting the movement direction of the opening and closing door 210, and forms a movement trajectory that moves while being in contact with the stud 242 of the link member 240 in a case where the opening and closing door 210 moves to the opened position.

The switching member 800 includes a root portion 802 and an arm 804 extending from the root portion 802 to an opposite side to the housing 100, and the first rotational moment M1 toward the first guide surface 221 using the root portion 802 as an axis is applied to the arm 804. The top surface of the arm 804 on a tip end side is in contact with the first guide surface 221 by the first rotational moment M1.

Figure 11A:
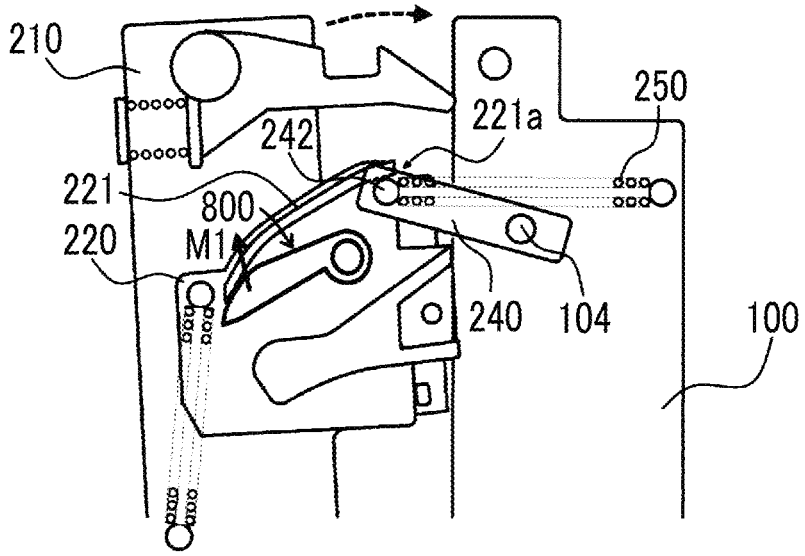
FIGS. 11A to 11C are schematic views for illustrating a drawing operation of the opening and closing door by a link member when the opening and closing door moves to a closed position.
Figure 11B:
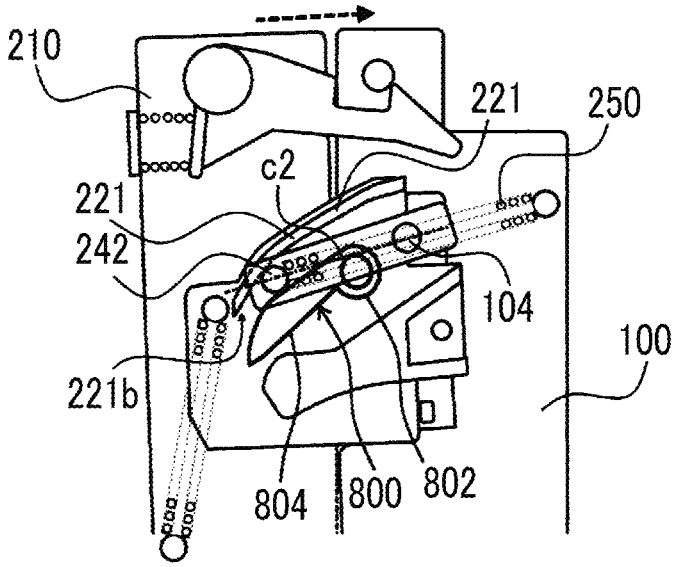
Figure 11C:
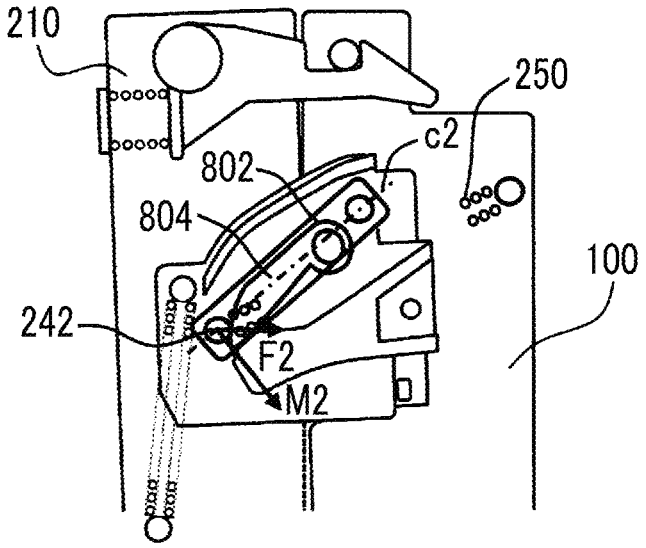

The stud 242 of the link member 240 is in contact with the upper surface of the arm 804 of the switching member 800, and the arm 804 is pushed down to surmount the first rotational moment M1 and is rotated to the vicinity of a starting end 222*a* of the second guide surface 222 below the terminal end 221*b* of the first guide surface 221 (see FIGS. 11B and 11C). Further, in the switching member 800, in a case where the stud 242 of the link member 240 guided by the first guide surface 221 exceeds a top dead center near the terminal end 221*b* of the first guide surface 221, the arm 804 receives the reversed second rotational moment M2 of the link member 240. Accordingly, a drawing force to the housing 100 side is applied to the opening and closing door 210, and an operation force to the closed position of the opening and closing door 210 is reduced. The rotation of the switching member 800 toward the second guide surface 222 is regulated by contact of the lower surface of the arm 804 on a tip end side with the second guide surface 222.

As shown in FIG. 5, a proximal end side 240*a* of the link member 240 is rotatably supported by a rotary shaft 104 provided in the housing 100. A tip end side 240*b* has the stud 242 protruding in a direction intersecting the rotational direction, and the tensile coil spring 250 is hung on the stud 242. As a result, the link member 240 is reversed either in a clockwise direction or in a counterclockwise direction with, as a top dead center, a position where the hanging direction of the tensile coil spring 250 and an imaginary line c2 connecting the rotary shaft 104 and the stud 242 overlap with each other on the same straight line, so that the second rotational moment M2 is applied by the tensile coil spring 250 (see arrow M2 of FIGS. 5A and 5B).

(2.5) Switching Member

Figure 6:
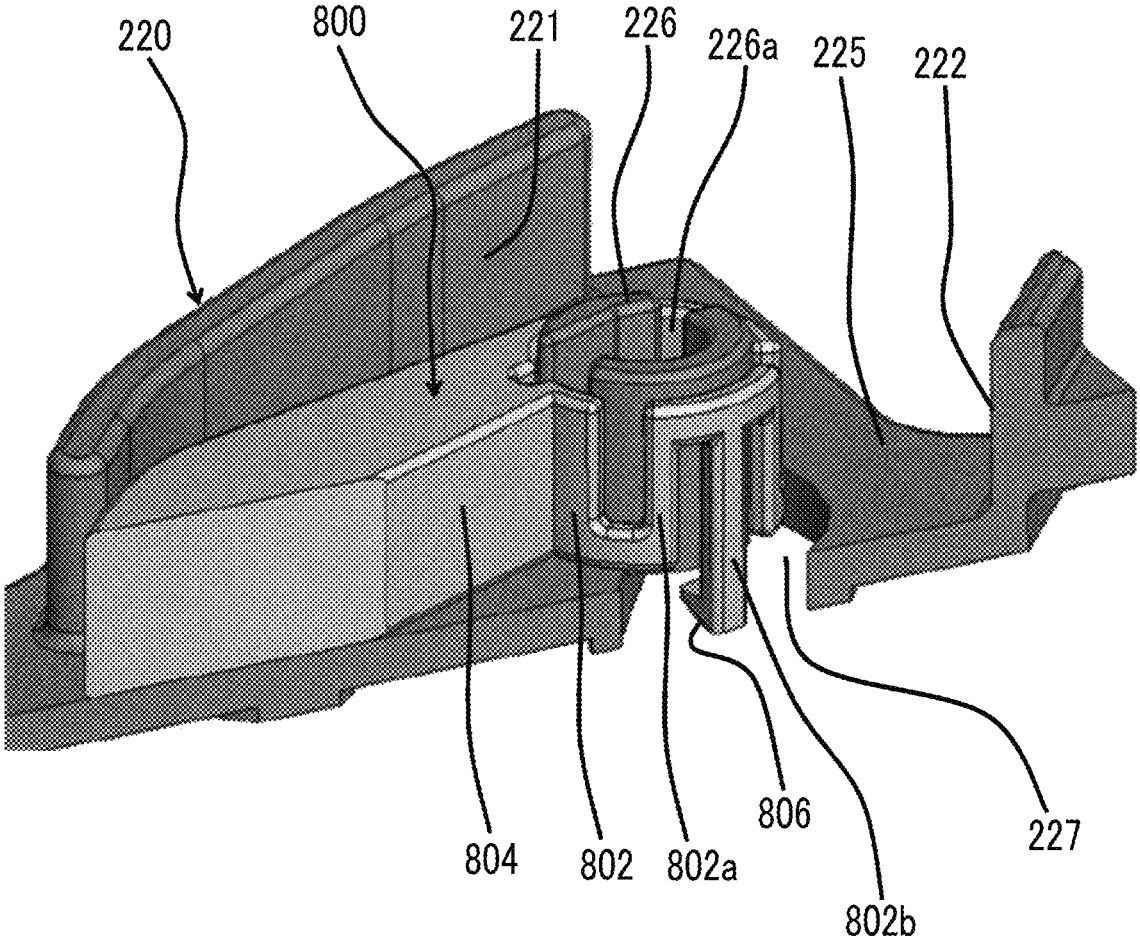
FIG. 6 is a perspective view showing an attachment structure of a switching member to a guide member.
Figure 7:
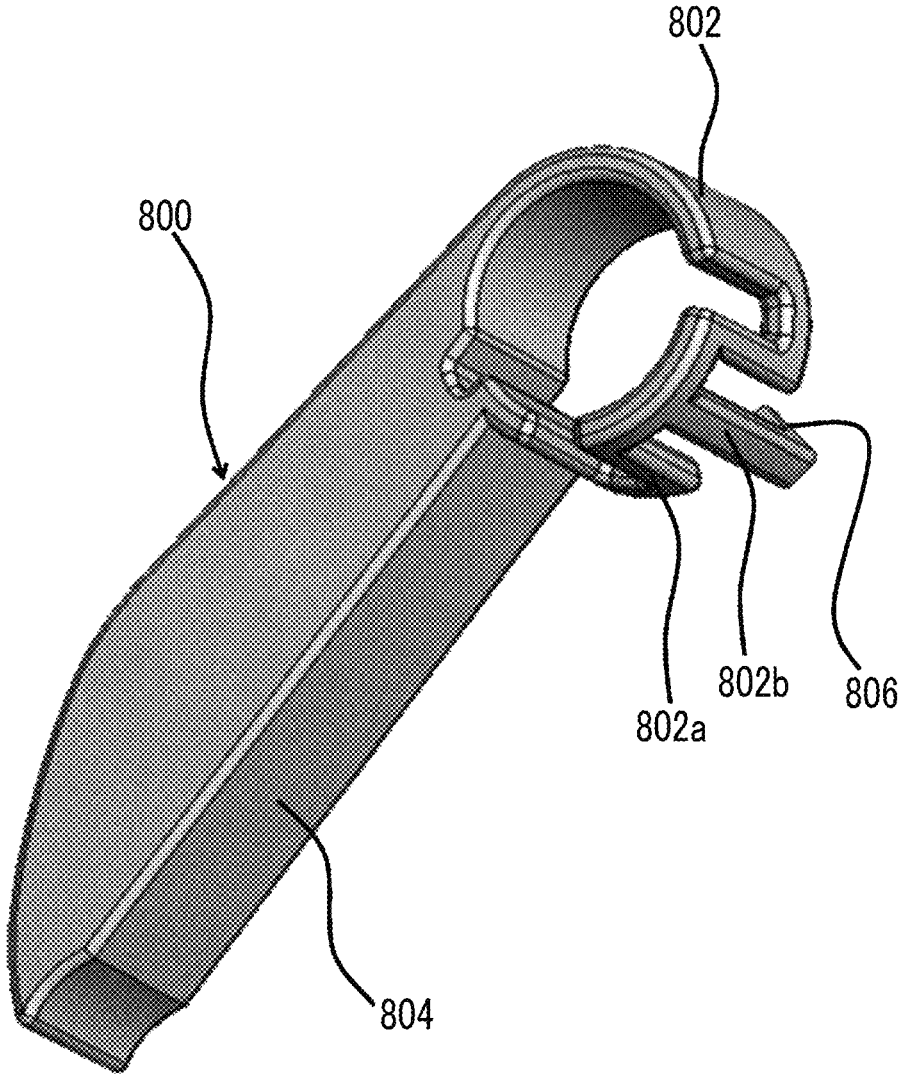
FIG. 7 is a front perspective view showing the switching member.
Figure 8:
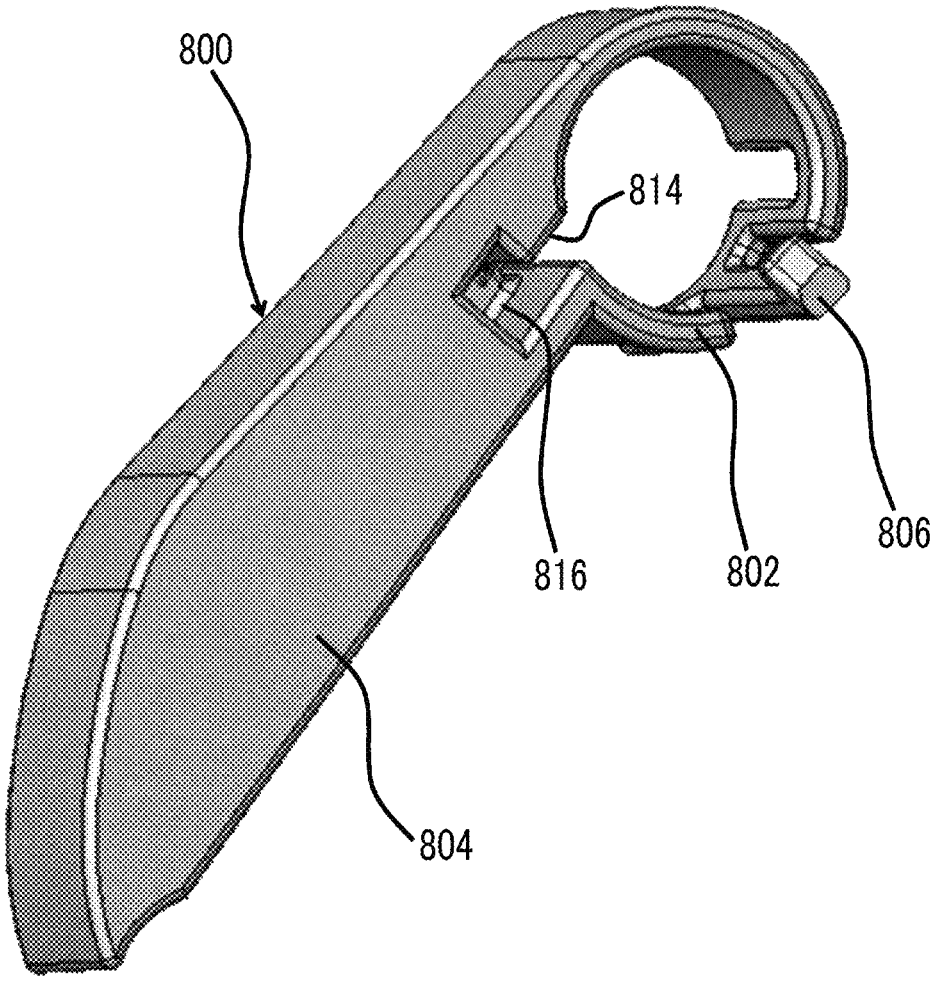
FIG. 8 is a rear perspective view showing the switching member.
Figure 9:
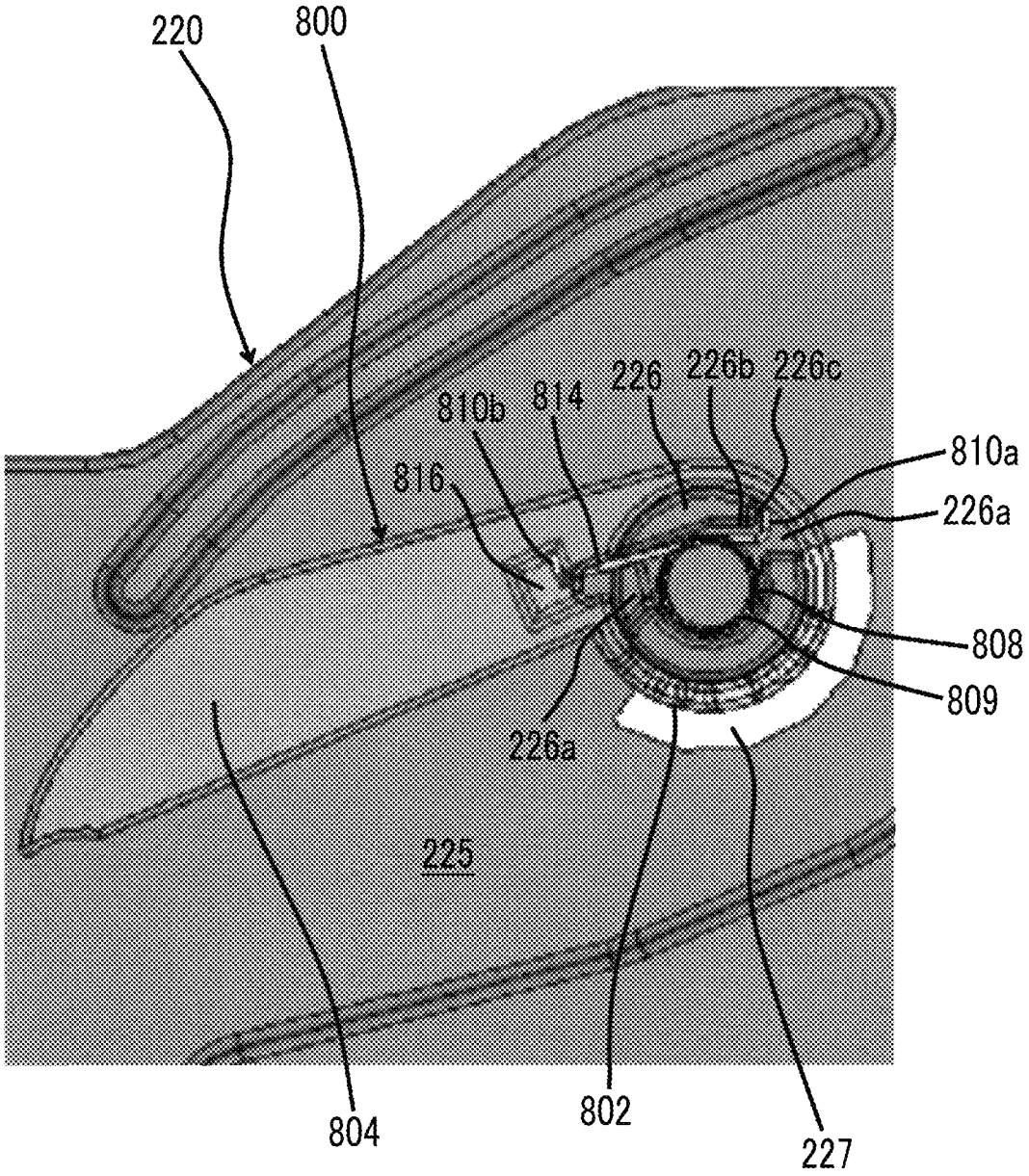
FIG. 9 is a diagram for illustrating a structure for causing a first rotational moment to an arm of the switching member.

Here, the switching member 800 will be described in detail. FIG. 6 is a perspective view showing an attachment structure of the switching member 800 to the guide member 220, FIG. 7 is a front perspective view showing the switching member 800, FIG. 8 is a rear perspective view showing the switching member 800, and FIG. 9 is a diagram for illustrating a structure for causing a first rotational moment M1 to an arm of the switching member 800. In FIG. 9, the switching member 800 is drawn semitransparently, and a torsion spring 808 (the first elastic member) disposed on a rear surface side of the switching member 800 is shown.

As shown in FIG. 6, the guide member 220 includes a plate-like base portion 225 facing a rear surface of the switching member 800, a cylindrical root receiving portion 226 protruding from the upper surface of the base portion 225, and a hole 227 (see FIG. 9) formed to correspond to a rotation range of the root portion 802 of the switching member 800, which is a hole formed in the annular base portion 225 along an outer periphery of the root receiving portion 226.

As shown in FIGS. 6 and 7, the root portion 802 of the switching member 800 has a cylindrical shape having a diameter that is larger than a diameter of the root receiving portion 226 of the guide member 220, and a linear portion 802*a* formed in a zigzag shape with an air gap therebetween is formed in a part of an outer peripheral wall of the root portion 802.

The root portion 802 has an engagement portion 802*b* as a part of the linear portion 802*a*, which extends toward the base portion 225 of the guide member 220, and a claw 806 is formed at a tip end of the engagement portion 802*b*.

While an inner peripheral surface of the root portion 802 of the switching member 800 is kept along an outer peripheral surface of the root receiving portion 226 of the guide member 220, the root portion 802 is inserted into the root receiving portion 226 from the upper side, and is rotatably attached to the root receiving portion 226. A tip end of the engagement portion 802*b* of the switching member 800 enters the hole 227 of the base portion 225 of the guide member 220, and the upper surface of the claw 806 of the switching member 800 is disposed to face the lower surface of the root receiving portion 226 of the guide member 220. Accordingly, separation of the root portion 802 of the switching member 800 from the root receiving portion 226 of the guide member 220 is prevented.

Since such a root portion 802 of the switching member 800 is attached to the guide member 220, as shown in FIG. 5B, a main body of the link member 240 may pass through an upper portion (a front surface side of the switching member 800) of the switching member 800 and rotate. Further, since the root portion 802 of the switching member 800 has a structure rotatably attached to an outer peripheral surface of the root receiving portion 226 of the guide member 220, the switching member 800 can be attached to the guide member 220, as a case where the switching member 800 is attached to the guide member 220 with a separate component provided.

Next, a structure in which the first rotational moment M1 is generated in the arm 804 of the switching member 800 will be described. As shown in FIG. 9, a torsion spring 808 for causing the first rotational moment M1 is disposed inside the cylindrical root receiving portion 226 of the guide member 220. The torsion spring 808 as the first elastic member includes a spring body 809 on which a spring wire is wound in a cylindrical shape and two spring end portions 810*a* and 810*b* formed in an L shape, which are tip ends of two spring wires projecting from the spring body 809.

The cylindrical root receiving portion 226 of the guide member 220 has a notch portion 226*a* (see FIGS. 6 and 9) formed by cutting a part of a wall. As shown in FIG. 9, an inner wall surface 226*b* of the root receiving portion 226 and an end surface 226*c* of the notch portion 226*a* of the root receiving portion 226 form a stepped portion (a first elastic receiving portion) that receives an L-shaped one end (the spring end portion 810*a*) of the torsion spring 808.

Further, as shown in FIGS. 8 and 9, the switching member 800 includes a quadrangular groove 816 formed on a rear surface thereof and a passage 814 causing the groove 816 and an inner space of the root portion 802 to communicate with each other. As shown in FIG. 9, an inner wall surface of the passage 814 and an inner wall surface of the groove 816 of the switching member 800 form a stepped portion (a second elastic receiving portion) that receives the L-shaped other end (the spring end portion 810*b*) of the torsion spring 808. That is, a spring wire extending from the spring body 809 of the torsion spring 808 disposed in the root receiving portion 226 of the guide member 220 toward the arm 804 of the switching member 800 reaches the groove 816 through the notch portion 226*a* (a notch portion different from the notch portion forming the first elastic receiving portion) of the root receiving portion 226 and the passage 814 of the switching member 800. The spring end portion 810*b*, which is a tip end of the spring wire reaching the groove 816, has a structure that can be received by the stepped portion.

As a procedure of attaching the torsion spring 808 to the switching member 800, first, the torsion spring 808 is disposed in the root receiving portion 226 of the guide member 220, and the root portion 802 of the switching member 800 may be inserted into the root receiving portion 226 of the guide member 220 from the upper side.

In this way, the root receiving portion 226 of the guide member 220 includes the stepped portion (the first elastic receiving portion) that receives one end of the torsion spring 808 (the first elastic member), the arm 804 of the switching member 800 includes the stepped portion (the second elastic receiving portion) that receives the other end of the torsion spring 808, and the first elastic receiving portion and the second elastic receiving portion receive the opposite ends of the torsion spring 808, respectively, so that the first rotational moment M1 is generated in the arm 804 of the switching member 800. According to this structure, since the torsion spring 808 is disposed inside the switching member 800, space saving is achieved. Further, according to this structure, the structure is simpler as compared to a case where the switching member 800 and the guide member 220 receive the end portions of the torsion spring 808 with separate components provided therein.

Hereinabove, the switching member 800 has been described. However, the structure of the switching member 800, the attachment structure of the switching member 800 to the guide member 220, and the structure in which the first rotational moment M1 is generated in the arm 804 of the switching member 800 are not limited thereto. For example, instead of the structure shown in FIG. 6, the attachment structure of the switching member 800 to the guide member 220 may be a structure in which a circular root receiving hole is formed in the base portion 225 of the guide member 220, a cylindrical protrusion shaft portion protruding to the base portion 225 of the guide member 220 is formed in the root portion 802 of the switching member 800, and the protrusion shaft portion of the root portion 802 of the switching member 800 is inserted into the root receiving hole of the base portion 225 of the guide member 220, so that the root portion 802 of the switching member 800 may be rotatably attached to the guide member 220.

Further, in the stepped portion receiving the two spring end portions 810*a* and 810*b* of the torsion spring 808, for example, the guide member 220 and the switching member 800 may be provided with a protrusion portion, a hole, and the like to form the stepped portion.

Figure 10:
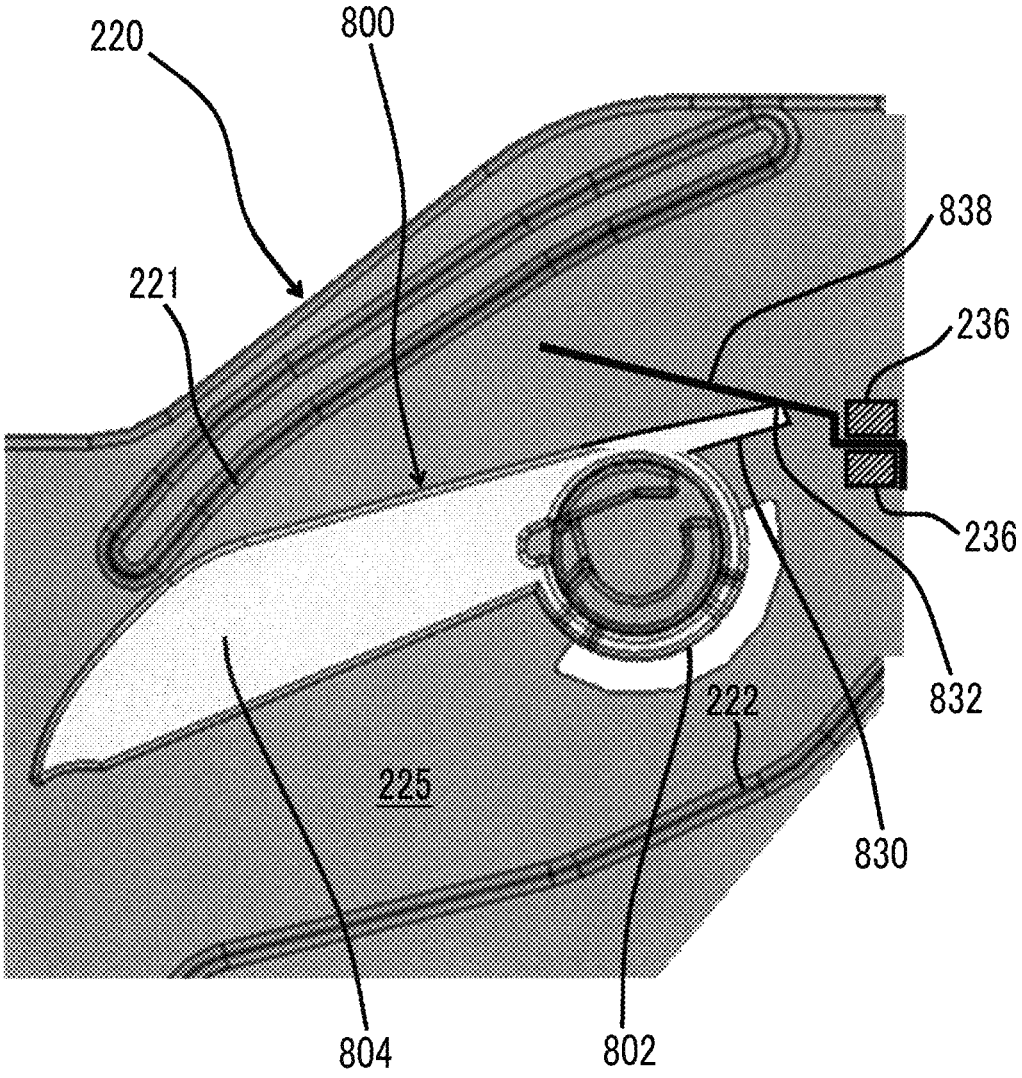
FIG. 10 is a diagram for illustrating another structure for causing the first rotational moment to the arm of the switching member.

Further, various elastic members such as other springs and rubber may be adopted as the first elastic member for generating the first rotational moment M1 in the arm 804 of the switching member 800. FIG. 10 shows another structure for generating the first rotational moment M1. In an example of FIG. 10, a leaf spring 838 is used as the first elastic member, the guide member 220 includes an elastic receiving portion 236 (the first elastic receiving portion) that protrudes from an upper surface of the base portion 225 and holds one end of the leaf spring 838 in a sandwiching manner, and the switching member 800 includes an extension portion 830 extending from an outer surface of the root portion 802 to an opposite side to the arm 804. The extension portion 830 of the switching member 800 includes an elastic receiving portion 832 (the second elastic receiving portion) that is a portion pressed against the leaf spring 838. In this structure, the extension portion 830 of the switching member 800 is urged toward the second guide surface 222 by the leaf spring 838, so that the first rotational moment M1 directed to the first guide surface 821 is generated in the arm 804 of the switching member 800. In this way, the first rotational moment M1 can be generated even by using the leaf spring 838. In a case where the structure shown in FIG. 10 is adopted, the extension portion 830 of the switching member 800, the elastic receiving portion 236 formed in the base portion 225 of the guide member 220, and the leaf spring 838 should be arranged on a side (the lower side) closer to the upper surface of the base portion 225 so as not to disturb movement of the stud 242 of the link member 240.

(3) Opening and Closing Operation of Opening and Closing door

Figure 12A:
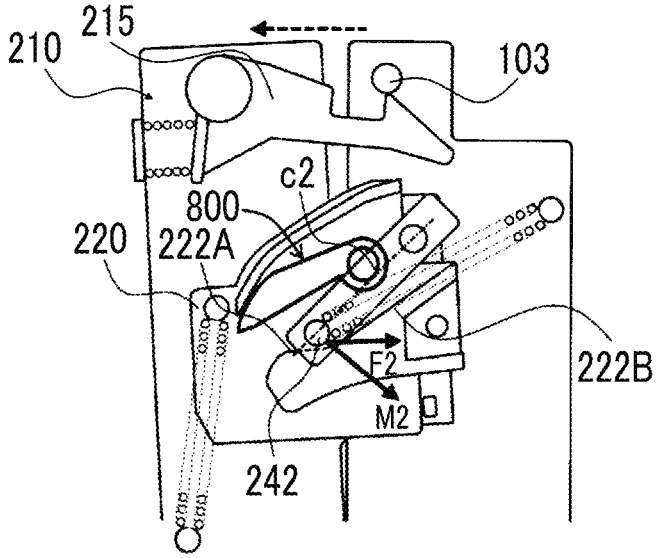
FIGS. 12A to 12C are schematic views for illustrating a return operation of the link member when the opening and closing door moves to an opened position.
Figure 12B:
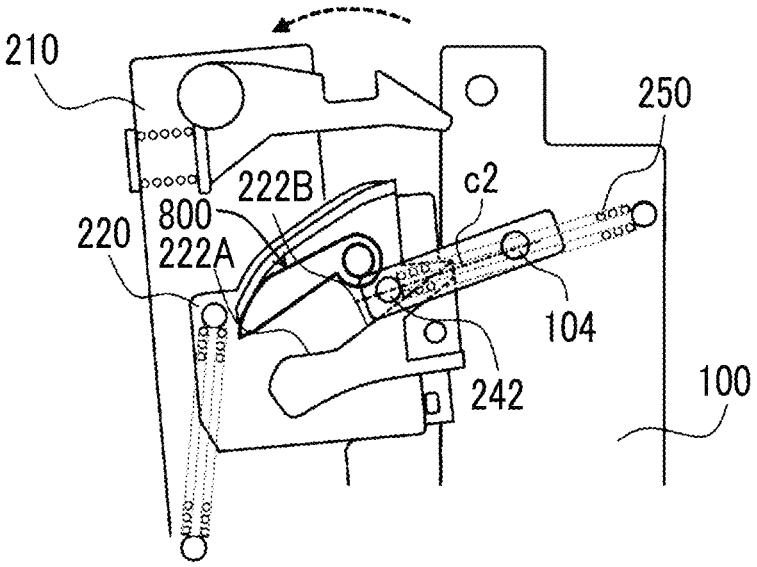
Figure 12C:
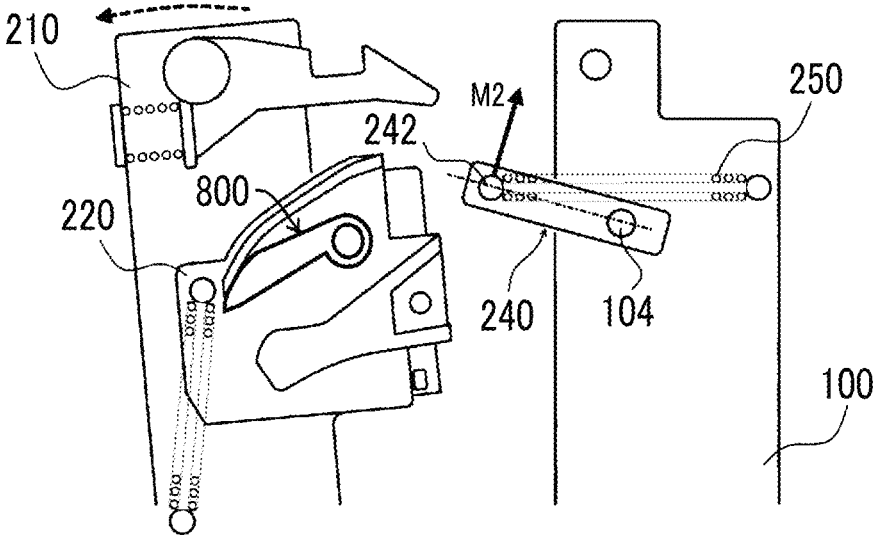
Figure 13:
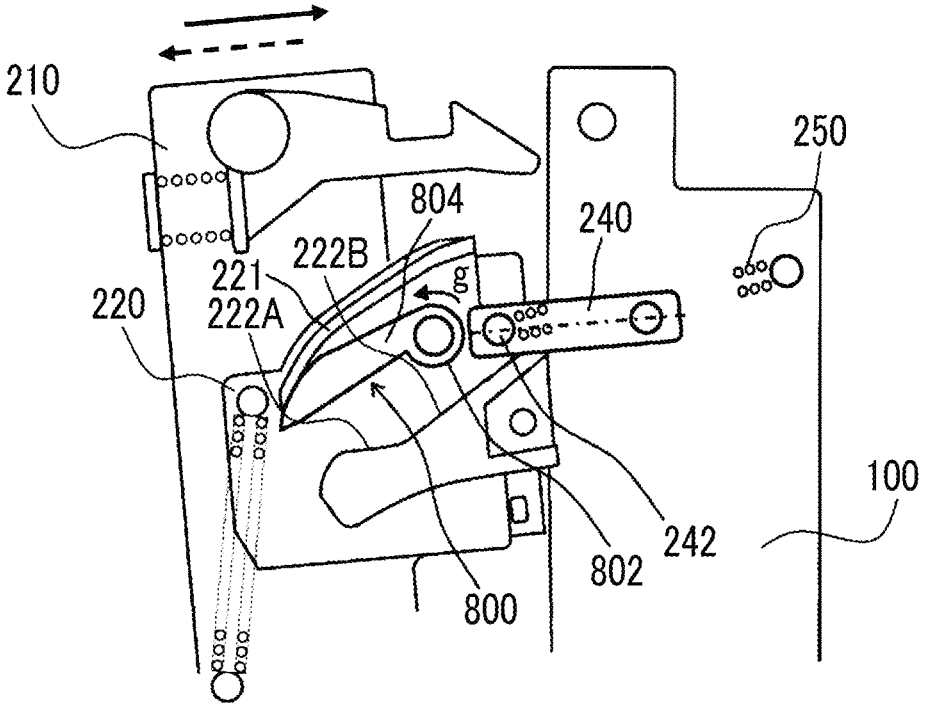
FIG. 13 is a schematic view for illustrating an operation of the link member when the opening and closing door moves to the closed position again after the opening and closing door moves slightly toward the opened position.

Next, an operation of the opening and closing mechanism 200 will be described with reference to the accompanying drawings. FIGS. 11A to 11C are schematic views for illustrating a drawing operation of the opening and closing door 210 by the link member 240 when the opening and closing door 210 moves to a closed position, FIGS. 12A to 12C are schematic views for illustrating a return operation of the link member 240 when the opening and closing door 210 moves to an opened position, and FIG. 13 is a schematic view for illustrating an operation of the link member 240 when the opening and closing door 210 moves to the closed position again after the opening and closing door 210 moves slightly toward the opened position.

(3.1) Closing Operation of Opening and Closing Door

First, a closing operation of the opening and closing door 210 will be described. In a case where the opening and closing door 210 returns from the opened position to the closed position, in a case where the opening and closing door 210 rotationally moves to the housing 100 side, the guide member 220 fixed to the opening and closing door 210 also rotationally moves to the housing 100 side, and the stud 242 of the link member 240 disposed in the housing 100 comes into contact with the starting end 221*a* side of the first guide surface 221 (see FIG. 11A).

Then, in a case where the opening and closing door 210 further rotationally moves to the closed position, the stud 242 of the link member 240 rotates along the movement trajectory of the first guide surface 221 and is located at the top dead center near the terminal end 221*b* of the first guide surface 221. The second rotational moment M2 is not applied (see FIG. 11B). At this time, the stud 242 of the link member 240 is in contact with the upper surface of the arm 804 of the switching member 800, and the stud 242 surmounts the first rotational moment M1 of the arm 804 of the switching member 800 to slightly push down the arm 804.

Then, the link member 240 in which the stud 242 reaches the top dead center further pushes down the arm 804 of the switching member 800 simultaneously while the direction of the second rotational moment M2 is reversed. Then, in a state in which the arm 804 of the switching member 800 is in contact with the second guide surface 222 of the guide member 220 and rotation of the arm 804 is regulated, the arm 804 receives the second rotational moment M2 by the link member 240 of which the direction is reversed. A drawing force F2 based on the reversed second rotational moment M2 of the link member 240 is applied to the opening and closing door 210 in the direction of the closed position (see FIG. 11C). Accordingly, the reaction force due to the nipped state of the resist roller pair 25 and the nipped state of the secondary transfer roller 62 can be partially offset to reduce an operation force.

Further, in a case where the opening and closing door 210 rotationally moves to the closed position, the stud 242 of the link member 240 moves from the upper surface of the arm 804 of the switching member 800 to the second guide surface 222 of the guide member 220. By applying the first rotational moment M1, the arm 804 is rotated toward the first guide surface 221 and comes into contact with the first guide surface 221 to return to an original position thereof (see FIG. 5B). Accordingly, the link member 240 is guided from the first guide surface to the second guide surface by the switching member 800 to reach the closed position. Then, the recess 215*a* of the latch lever 215 is fitted in the lock pin 103 provided in the housing 100, so that the opening and closing door 210 is fixed at the closed position.

(3.2) Opening Operation of Opening and Closing Door

Next, an opening operation of the opening and closing door 210 will be described. In a case where the opening and closing door 210 moves from the closed position to the opened position, the latch lever 215 provided at an upper portion of the opening and closing door 210 is lifted up to release the engagement with the lock pin 103 provided in the housing 100, and the opening and closing door 210 rotationally moves to a lateral side (the −X direction in FIG. 1) of a main body of the image forming apparatus 1. In a case where the rotational movement of the opening and closing door 210 starts, the stud 242 of the link member 240 rotates along the first guide portion 222A of the second guide surface 222 of the guide member 220. Since the first guide portion 222A has a gentle inclination angle along the movement direction of the opening and closing door 210, the first guide portion 222A has the same direction as an action direction of the drawing force F2 by the second rotational moment M2 (see FIG. 12A), and an increase in an operation force of the opening operation of the opening and closing door 210 is suppressed.

In a case where the opening and closing door 210 further rotationally moves, the stud 242 of the link member 240 rotates along the second guide portion 222B having a steeper inclination angle than the inclination angle of the first guide portion 222A and is located at the top dead center, and the second rotational moment M2 is not applied (see FIG. 12B). Then, with the rotational movement of the opening and closing door 210, the link member 240 returns to a standby position where the direction of the second rotational moment M2 is reversed and the rotational movement of the opening and closing door 210 to the closed position is received (see FIG. 12C).

In this way, in a case where the opening and closing door 210 returns from the opened position to the closed position, while the link member 240 disposed in the housing 100 rotates along the first guide surface 221 of the guide member 220, the direction of the second rotational moment M2 is reversed near the terminal end 221*b* of the first guide surface 221, a drawing force F based on the link member 240 is applied to the opening and closing door 210, and thus the operation force can be reduced. Meanwhile, in a case where the opening and closing door 210 moves from the closed position to the opened position, the link member 240 for assisting the opening operation of the opening and closing door 210 rotates along the first guide portion 222A having a gentle inclination angle, belonging to the second guide surface 222, which is different from the closing operation, and an increase in the operation force during the opening operation is suppressed.

(3.3) Closing Operation Before Opening and Closing Door is Fully Opened

In a process of rotationally moving the opening and closing door 210 from the closed position to the opened position (see FIG. 12), before the opening and closing door 210 is fully opened (see FIG. 12C), that is, before the link member 240 returns to the standby position where the link member 240 receives the rotational movement of the opening and closing door 210 to the closed position, the opening and closing door 210 may be closed again (the closing operation starts). In this case, as shown by an arrow g of FIG. 13, before returning to the standby position, the link member 240 is directly directed to the first guide surface 221 of the guide member 220.

Here, since there is no portion of the switching member 800 protruding from the root portion 802 to the housing 100 side, the stud 242 of the link member 240 is slightly in contact with or is not in contact with an outer surface of the root portion 802, and thus can be smoothly directed to the first guide surface 221. That is, in a case where the switching member 800 has a portion protruding from the root portion 802 to the housing 100 side, the stud 242 of the link member 240 hits the protrusion portion, and thus cannot be directed to the first guide surface 221. Further, the stud 242 of the link member 240 pushes the switching member 800 with a strong force, and thus the switching member 800 and a shaft portion (such as the root receiving portion of the guide member) that supports the switching member 800 may be damaged. However, since the switching member 800 according to the present exemplary embodiment has no portion protruding from the root portion 802 to the housing 100 side, damage to components of the opening and closing mechanism can be suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An opening and closing mechanism comprising:

an opening and closing door that is rotatably supported to be movable between a closed position where an opening of an apparatus body is covered and an opened position where the opening is opened;

a link member provided in the apparatus body and rotatably supported by a rotary shaft;

a guide member having a first guide surface that moves while being in contact with the link member in a case where the opening and closing door moves to the closed position and a second guide surface that moves while being in contact with the link member in a case where the opening and closing door moves to the opened position; and a switching member that guides the link member from the first guide surface to the second guide surface, wherein the switching member includes a root portion and an arm extending from the root portion to an opposite side to the apparatus body, and wherein a first rotational moment toward the first guide surface using the root portion as an axis is applied to the arm.

2. The opening and closing mechanism according to claim 1, wherein the root portion of the switching member is rotatably attached to the guide member.

3. The opening and closing mechanism according to claim 2, wherein the guide member includes a base portion facing a rear surface of the switching member and a root receiving portion protruding from an upper surface of the base portion, and wherein the root portion of the switching member is rotatably attached to an outer peripheral surface of the root portion of the guide member.

4. The opening and closing mechanism according to claim 3, further comprising:

a first elastic member, wherein the switching member includes an extension portion extending from an outer surface of the root portion to an opposite side to the arm, and wherein the extension portion of the switching member is urged toward the second guide surface by the first elastic member, so that the first rotational moment is generated.

5. The opening and closing mechanism according to claim 4, wherein the first elastic member is a leaf spring, wherein the guide member includes a first elastic receiving portion that protrudes from the upper surface of the base portion and receives one end of the leaf spring, and wherein the extension portion of the switching member includes a second elastic receiving portion against which the leaf spring is pressed.

6. The opening and closing mechanism according to claim 3, wherein a second elastic member is hung on a tip end side of the link member, and the link member rotates about the rotary shaft while receiving a second rotational moment.

7. The opening and closing mechanism according to claim 3, further comprising:

a first elastic member, wherein the root receiving portion of the guide member includes a first elastic receiving portion that receives one end of the first elastic member, wherein the arm of the switching member includes a second elastic receiving portion that receives the other end of the first elastic member, and wherein the first elastic receiving portion and the second elastic receiving portion receive both ends of the first elastic member, respectively, so that the first rotational moment is generated.

8. The opening and closing mechanism according to claim 7, wherein at least one of the first elastic receiving portion or the second elastic receiving portion is a stepped portion to which an end portion of the first elastic member is caught.

9. The opening and closing mechanism according to claim 7, wherein the root receiving portion of the guide member has a cylindrical shape in which a part of a wall is cut out, and wherein the first elastic receiving portion of the guide member is a stepped portion formed by an inner wall surface of the root receiving portion and an end surface of the cut portion of the root receiving portion.

10. The opening and closing mechanism according to claim 7, wherein the second elastic receiving portion of the switching member is a groove formed in the arm of the switching member.

11. The opening and closing mechanism according to claim 2, wherein the guide member includes a base portion facing a rear surface of the switching member and a root receiving hole formed in the base portion, wherein the root portion of the switching member includes a protrusion shaft portion protruding to the base portion of the guide member, and wherein the protrusion shaft portion of the root portion of the switching member is inserted into the root receiving hole of the guide member, so as to be rotatably attached.

12. The opening and closing mechanism according to claim 11, further comprising:

a first elastic member, wherein the switching member includes an extension portion extending from an outer surface of the root portion to an opposite side to the arm, and wherein the extension portion of the switching member is urged toward the second guide surface by the first elastic member, so that the first rotational moment is generated.

13. The opening and closing mechanism according to claim 12, wherein the first elastic member is a leaf spring, wherein the guide member includes a first elastic receiving portion that protrudes from the upper surface of the base portion and receives one end of the leaf spring, and wherein the extension portion of the switching member includes a second elastic receiving portion against which the leaf spring is pressed.

14. The opening and closing mechanism according to claim 11, wherein a second elastic member is hung on a tip end side of the link member, and the link member rotates about the rotary shaft while receiving a second rotational moment.

15. The opening and closing mechanism according to claim 2, wherein a second elastic member is hung on a tip end side of the link member, and the link member rotates about the rotary shaft while receiving a second rotational moment.

16. The opening and closing mechanism according to claim 1, wherein a second elastic member is hung on a tip end side of the link member, and the link member rotates about the rotary shaft while receiving a second rotational moment.

17. The opening and closing mechanism according to claim 16, wherein when the opening and closing door is moved from the opened position to the closed position, the tip end side of the link member, on which the elastic member is hung, exceeds a top dead center at least at a terminal end portion of the first guide surface, so that a direction of the second rotational moment is reversed, and the guide member is drawn in a movement direction of the opening and closing door.

18. The opening and closing mechanism according to claim 17, wherein the arm of the switching member moves to the second guide surface side while receiving the second rotational moment of the link member by coming into contact with the link member of which the second rotational moment is reversed at least at the terminal end portion of the first guide surface, and guides the link member to the second guide surface.

19. The opening and closing mechanism according to claim 18, wherein the second guide surface includes a first guide portion having a gentle inclination angle along the movement direction of the opening and closing door and a second guide portion having a steeper inclination angle than the inclination angle of the first guide portion in a direction intersecting the movement direction of the opening and closing door, and when the opening and closing door moves from the closed position to the opened position, as the opening and closing door moves to the opening position while the link member rotates along the first guide portion, the link member rotates along the second guide portion, and the tip end side on which the second elastic member is hung exceeds the top dead center, so that the direction of the second rotational moment is reversed.

20. An image forming apparatus comprising:

an image forming unit that forms an image on a paper sheet;

a paper sheet transporting unit that transports the paper sheet toward the image forming unit; and the opening and closing door according to claim 1.

* * * * *